US005102044A

United States Patent [19]

Inoue et al.

[11] Patent Number: 5,102,044

[45] Date of Patent: Apr. 7, 1992

[54] METHOD FOR PRODUCING SNOW AND APPARATUS THEREFOR

[75] Inventors: Masanori Inoue; Susumu Kishi; Katsutoshi Harima, all of Tokyo, Japan

[73] Assignee: NKK Corporation, Tokyo, Japan

[21] Appl. No.: 655,219

[22] Filed: Feb. 12, 1991

Related U.S. Application Data

[63] Continuation of Ser. No. 403,094, Sep. 5, 1989, abandoned.

[30] Foreign Application Priority Data

Sep. 30, 1988 [JP] Japan ..... 63-246584

[51] Int. Cl.[5] ..... F25C 3/04

[52] U.S. Cl. ..... 239/2.2

[58] Field of Search ..... 62/72; 239/2.2, 14.2

[56] References Cited

U.S. PATENT DOCUMENTS

| | | | |
|---|---|---|---|
| 3,024,117 | 3/1962 | Barlow | 62/74 X |
| 3,464,625 | 9/1989 | Carlsson | 239/2.2 |
| 3,703,991 | 11/1972 | Eustis et al. | 239/2.2 |
| 3,814,319 | 6/1974 | Loomis | 239/2.2 |
| 3,948,442 | 4/1976 | Dewey | 239/2.2 |
| 3,952,949 | 4/1976 | Dupre | 239/2.2 |
| 3,979,061 | 9/1976 | Kircher | 239/2.2 |
| 4,347,703 | 9/1982 | Lukasavage | 62/74 X |
| 4,742,958 | 5/1988 | Bucceri | 239/2.2 |
| 4,790,531 | 12/1988 | Matsui et al. | 239/2.2 X |

*Primary Examiner*—Andres Kashnikow
*Assistant Examiner*—Kevin P. Weldon
*Attorney, Agent, or Firm*—Frishauf, Holtz, Goodman & Woodward

[57] ABSTRACT

A method for artificially producing snow, which is used for an indoor skiing facility. The method comprises maintaining an inside temperature of the indoor skiing facility of 0° C. or less and blowing air and water with an air-water ratio of 300 to 3000 $Nm^3/m^3$ in volume from a plurality of two-fluid spraying nozzles to generate and spread waterdrops of a particle size of 5 to 200 μm, into the indoor skiing facility. The spray nozzles are disposed adjacent an upper portion of a cover enclosure of the indoor skiing facility. An apparatus for artificially producing snow. The apparatus comprising an indoor skiing facility having a floor and a cover enclosure comprising a ceiling and side walls. The cover enclosure and the floor are made from an insulating material. Holes are provided for blowing cold air into the indoor skiing facilities. The holes for blowing air are disposed adjacent an upper portion of the cover enclosure. Holes are provided for exhausting air from the indoor skiing facilities. The holes for exhausting air are disposed adjacent a comparatively lower portion of the side walls of the cover enclosure. A plurality of two-fluid spray nozzles are provided for blowing air and water into the indoor skiing facilities. The spray nozzles are disposed adjacent the upper portion of the cover enclosure.

19 Claims, 2 Drawing Sheets

METHOD FOR PRODUCING SNOW AND APPARATUS THEREFOR

This application is a continuation of application Ser. No. 07/403,094, filed Sept. 5, 1989 now abandoned.

BACKGROUND OF THE INVENTION

1. Field of the Invention

The present invention relates to a method for producing man-made snow and an apparatus therefor, and more particularly to a method for producing man-made snow in an indoor skiing facility and an apparatus therefor.

2. Description of the Prior Arts

In recent years, indoor skiing facilities have been constructed everywhere for men and women enjoying winter sports on the outerskirts of towns and cities. It is necessary to produce snow artificially indoors and to have the snow lie on the floor at a predetermined thickness in an indoor skiing facility.

The following methods are known as such methods for producing snow:

(A) A method for producing snow by scattering a highly-water-absorbing resin (water-absorbing polymer) on brine pipes laid on the floor and having the resin disposed thereon and by freezing the resin by means of said brine pipes.

(B) A method for producing snow by making lumps of ice, then breaking the lumps of ice into small pieces, scattering the small pieces of ice on the floor and having the small pieces of ice disposed thereon.

(C) A method for producing snow by use of natural cold air with the use of a gun type snow-making machine having two-fluid nozzles jetting water together with compressed air from nozzles or with the use of a fan type snow-making machine, on a position close to a fan of which a number of water-jetting nozzles are mounted.

(D) A method for producing snow by jetting water together with compressed air into an indoor space by use of two-fluid nozzles, generating a water mist, having the mist attached to a grating mounted on a ceiling by cold air, scraping off snow/ice, to which the mist converts into and which had attached to the grating, having the snow ice fall on the floor and having the snow ice lie on the floor.

There, however, are the following problems in the above-mentioned prior art methods for producing snow:

(a) Since said method (A) is a method for making snow by freezing a polymer having absorbed water by means of brine pipes, the produced man-made snow is liable to be ice in the state of sherbet. Accordingly, it is impossible to produce compact snow and powdery snow like natural snow by the use of said method. Further, it is difficult to glide over the snow produced by the use of polymers, because of the properties of the water-absorbing polymer. When the snow produced by the use of polymers melts, the snow converts into sticky material in the state of a gel and is hard to dry when it sticks to clothes. Moreover, such snow is liable to corrode a metallic portion of skis and other metals.

(b) In said method (B), since small pieces of ice obtained by breaking lumps of ice are scattered on the floor, produced man-made snow has a form of granulated sugar. Accordingly, it is impossible to produce compact snow and powdery snow like natural snow by the use of said method. In addition, since three steps of a manufacturing of ice, a breaking of ice and a scattering of ice are required, the cost of equipment and the running cost increase.

(c) Even though said method (C) is appropriate for producing snow to be used for an outdoor skiing facility, a great amount of water and compressed air to be used are required and the calories required for converting water to ice per unit increases. Accordingly, there is a high cost of equipment for a refrigeration machine and an increased running cost. Further, since sizes of waterdrops obtained by spraying water with use of a gun type snow-making apparatus are from over 200 to 400 $\mu$m, heat exchange of the waterdrops with surrounding cold air is poor. In consequence, the waterdrops are difficult to convert to snow indoors.

(d) Since snow ice attached to the ceiling is scraped off and made to fall on the floor by the use of said method (D), equipment for scraping off the snow/ice from the ceiling is required. Therefore, the cost of equipment and the running cost increase. Further, since the snow/ice is required to be wet to some extent so that the snow/ice can attach to the ceiling, it is impossible to produce powdery snow and to control properties of the snow so that the snow/ice can be of powdery snow, compact snow or ice in the state of sherbet. Furthermore, indoor temperatures have to be lowered considerably to have the mist generated by jetting water and compressed air attached to the ceiling. A great amount of calories is required therefor.

SUMMARY OF THE INVENTION

It is an object of the present invention to overcome the above-mentioned difficulties in the prior art methods for producing man-made snow in an indoor skiing facility and to provide a method for producing snow and an apparatus therefor wherein a great amount of man-made snow, substantially not different from natural snow in its appearance and properties can be produced with high efficiency indoors and the properties of the snow can be controlled.

To accomplish the above-mentioned object, the present invention provides a method for producing snow comprising:

keeping a temperature inside an indoor skiing facility at ° C. or less by blowing cold air from a plurality of blowing holes arranged on the walls of the indoor skiing facility; and generating waterdrops in the skiing facility by blowing air and water from two-fluid spraying nozzles arranged on the walls of the indoor skiing facility, said waterdrops being cooled by said cold air and converting to snow which lies on the floor of the indoor skiing facility.

Further, the present invention provides an apparatus for producing comprising:

a skiing facility, whose walls and floors are made of insulating materials;

holes for blowing cold air into said skiing facility, which are arranged in an upper portion of said walls;

holes for exhausting cold air in said skiing facility, which are arranged in a lower portion of said walls; and a plurality of two-fluid spraying nozzles for blowing water together with compressed air into said skiing facility, which are arranged on the walls of the skiing facility.

The above objects and other objects and advantages of the present invention will become apparent from the detailed description to follow, taken in connection with the appended drawings.

DESCRIPTION OF THE PREFERRED EMBODIMENT

Figure 1:
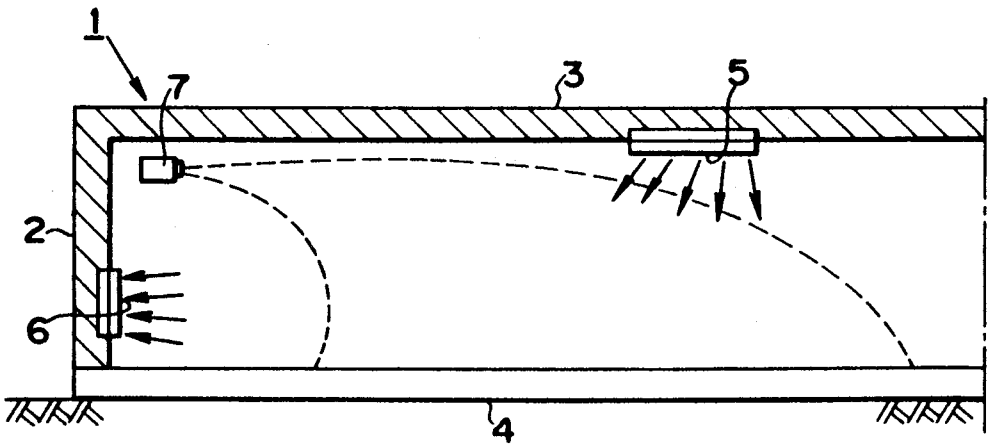
FIG. 1 is a vertical sectional view illustrating an embodiment of the present invention.
Figure 2:
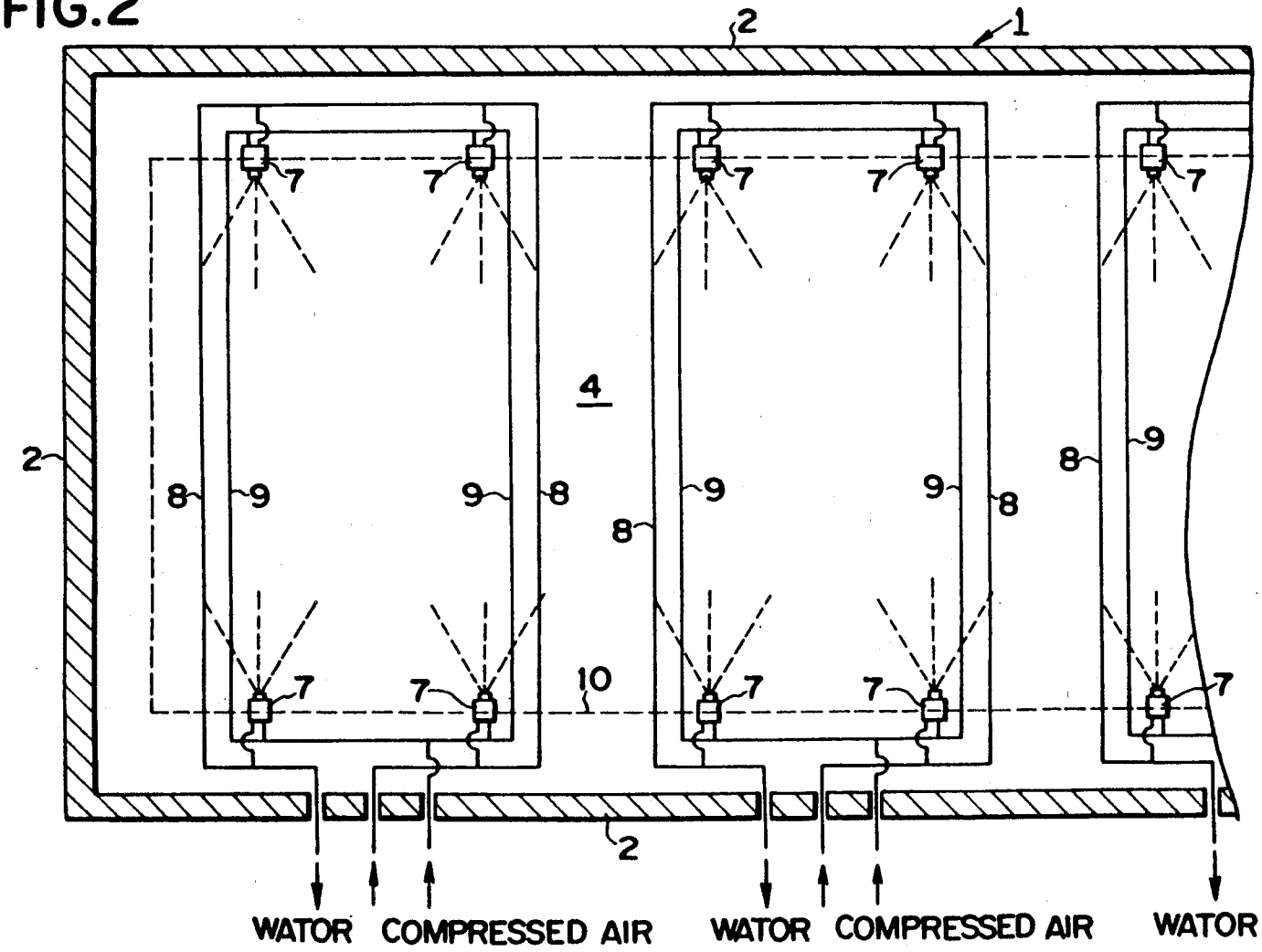
FIG. 2 is a side elevation illustrating the embodiment of the present invention.
Figure 2:
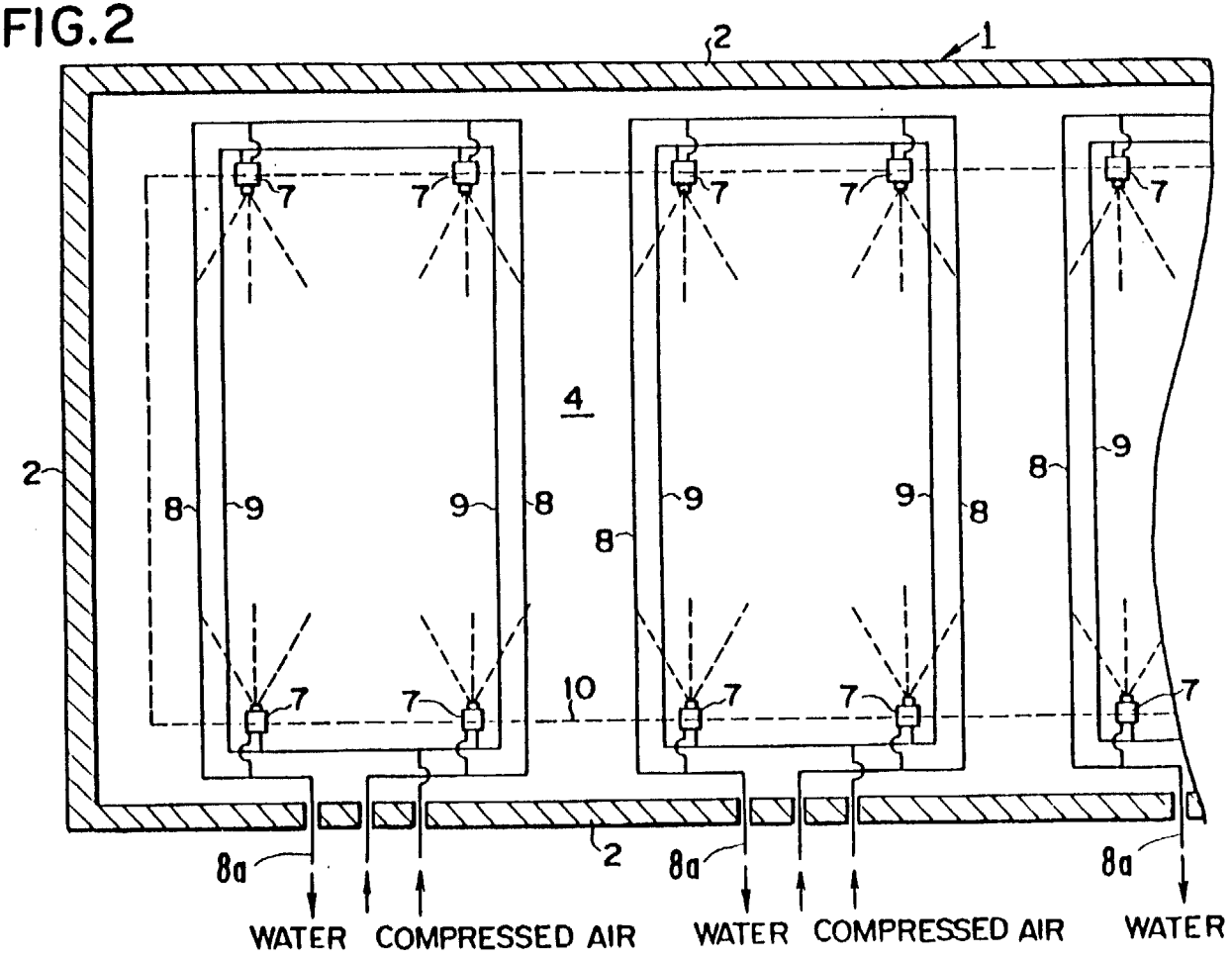

An example of the present invention will be described with specific reference to the appended drawings. FIG. 1 is a vertical sectional view illustrating an embodiment of the present invention. FIG. 2 is a horizontal sectional view illustrating the embodiment of the present invention. As shown with the drawings, skiing facility 1 has heat-insulating side wall 2, ceiling 3 and floor 4. Slope 10 is shown with a dotted line in FIG. 2.

Holes 5 for blowing cold air downward is arranged in a middle portion of ceiling 3 inside the indoor skiing facility. Cold air exhaust hole 6 for inhaling and exhausting cold air blown into the indoor skiing facility is arranged in a lower portion of one side wall. Cold air blowing hole 5 can be arranged in an upper portion of side wall 2. A plurality of two-fluid spraying nozzles 7 are positioned at a definite interval in an upper portion of side wall 2 in the longitudinal direction facing one another inside the indoor skiing facility. Two-fluid spraying nozzle 7 has a structure wherein water together with compressed air is jetted from an exhaust hole of a nozzle and is a nozzle of adiabatic expansion type, at the exhaust hole of which jetted compressed air expands. Sizes of jetted waterdrops can be changed by controlling an air-water ratio.

Said air-water ratio is an air-water ratio represented with $Nm^3$ of compressed air and $m^3$ of water. When the air-water ratio is less than 300, man-made snow-like sherbet is obtained. On the other hand, when the air-water ratio is more than 3000, a small amount of man-made snow is obtained. Therefore, snow-making with the air-water ratio of more than 3000 is not put to practical use. Accordingly, the air-water ratio is desired to be from 300 to 3000.

In FIG. 2, reference numerals 8 and 9 denote conduits which supply water and compressed air to two-fluid spraying nozzles 7 respectively and which are positioned under floor 4. Conduit 8 and conduit 9 are connected to a water supply source and to a compressed air supply source (both of them are not shown) positioned outdoors and conduit 8 exhausts water to the outside (see arrows in FIG. 2) via conduit portion 8*a*.

Water together with compressed air are jetted from each of two-fluid spraying nozzles 7 into indoor facility 1 as shown with arrow symbols in FIG. 1. Jetted waterdrops are cooled by cold air blown from cold air holes 5, converted to snow and lie on the floor in indoor facility 1.

The waterdrops jetted from two-fluid spraying nozzles 7 into indoor facility 1 are required to be of a substantially uniform particle size of 5 to 200 μm. A ratio of surface area to volume of the waterdrops becomes large compared with, that of waterdrops of over 200 to 400 μm in particle size which are jetted from the prior art outdoor snow-making apparatus. Moreover, the waterdrops are suspended in the air for a long time as a result that their weights become small owing to their small particle sizes. Accordingly, the waterdrops jetted into indoor facility 1 are exposed to the cold air blown from cold air blowing holes 5 for a long time. Thereby, a heat exchange ratio of the waterdrops is increased and the waterdrops are effectively cooled. Man-made snow with uniformity of its properties can be manufactured by making the particle sizes of the waterdrops substantially uniform. When a particle size of waterdrops are more than 200 μm and a distribution of particle sizes ranges widely, the above-mentioned high effect of cooling cannot be obtained. On the other hand, when the particle size of the waterdrop is less than 5 μm, it is difficult for snow to fall on the ground and a ratio of discharge of the snow from cold air exhaust holes 6 increases. In consequence, an effectiveness of snow-making decreases and said cold exhaust holes 6 have a possibility of being blocked up. Uniform waterdrops of from 5 to 200 μm in particle size can be obtained by controlling the ratio of water to compressed air blown from two-fluid spraying nozzles 7.

As described above, the effect produced by making the waterdrops minute can be obtained only indoors. When minute waterdrops are jetted outdoors, most of the minute waterdrops jetted are blown away. In consequence, snow cannot be effectively made and cannot be accumulated in a predetermined facility.

Further, in the present invention, a plurality of two-fluid spraying nozzles 7 with small capacity are arranged at a definite interval along side walls 2 in indoor facility 1. Waterdrops are jetted simultaneously from spraying nozzles 7 into indoor facility 1. Accordingly, since the waterdrops can be uniformly blown into the entire space of indoor facility 1, the heat exchange ratio can be further increased than in case of arranging one spraying nozzle with a large capacity and the amount of cooling calorie per unit of space, which is required for securing the same amount of man-made snow, can be decreased.

The man-made snow produced in such a manner as described above can be optionally transformed into snow-like ice in the state of sherbet, compact snow and powdery snow by controlling the particle sizes of the waterdrops jetted from two-fluid spraying nozzles 7, temperatures of the compressed air, a ratio of water to the compressed air and temperatures of the space in indoor facility 1.

As described above, according to the present invention, the following good effects can be obtained:

(1) The man-made snow has the same properties as those of natural snow.

(2) The man-made snow can be freely transformed into various types of snow such as ice in the state of sherbet, compact snow and powdery snow.

(3) Since the particle sizes of the waterdrops are minute, the heat exchange ratio of the waterdrops is extremely good. Therefore, snow of good quality can be produced at room temperatured close to 0° C.

(4) A great amount of snow of good quality can be effectively and stably produced regardless of climate.

(5) Since an initial cost and running cost of a refrigeration machine can be decreased, the method of the present invention and the apparatus therefor are effective.

An example of the method of the present invention will be described with specific reference to the figures.

The total number of 40 two-fluid spraying nozzles 7 were arranged at an interval of 15 m and at a height of 6 m along side walls 2 facing one another in the longitudinal direction in an indoor facility of 300 m in length, 50 m in width and 6 m in height. Water together with compressed air were jetted from each of two-fluid spraying nozzles 7 under the following conditions:

Temperature of water supplied to nozzles: 3.8° C.
Temperature of compressed air supplied to nozzles: 21.5° C.
Particle size of jetted waterdrops (D): 40 μm
Temperature of indoor space (Tr): −5° C.
Rate of snow-making: 1.35 mm/Hr.

As a result, substantially the same powdery snow of 0.252 g/cm$^3$ in density as natural snow could be uniformly produced.

Subsequently, snow was made by determining a temperature of water supplied to nozzles at 10° C. and a temperature of compressed air at 20° C. and by changing a temperature of an indoor space (Tr) and particle sizes of waterdrops (D). As a result, the properties of the snow could be changed as shown below.

(a) In case of $-6° C. \leqq TR \leqq -4° C.$

| | |
|---|---|
| 60 μm ≦ D | snow-like ice in the state of sherbet |
| 40 μm ≦ D < 60 μm | compact snow |
| D < 40 μm | powdery snow |

(b) In case of $-4° C. \leqq Tr \leqq -2° C.$

| | |
|---|---|
| 40 μm ≦ D | snow-like ice in the state of sherbet |
| 20 μm ≦ D < 40 μm | compact snow |
| D < 20 μm | powdery snow |

What is claimed is:

1. A method for artificially producing snow, which is used for an indoor skiing facility, comprising the steps of:

providing holes for blowing cold air into the indoor skiing facility;

providing holes for exhausting air from the indoor skiing facility;

providing holes for exhausting air from the indoor skiing facility;

maintaining an inside temperature of the indoor skiing facility at 0° C. or less by means of said holes for blowing cold air and for exhausting air;

providing compressed air supply means, water supply means and water exhaust means; and blowing compressed air and water with an air-water ratio of 300 to 3000 Nm$^3$/m$^3$ in volume through a plurality of grouped two-fluid spray nozzles to generate and spread waterdrops of a particle size of 5 to 200 μm into the indoor skiing facilities, said grouped two-fluid spray nozzles being spaced apart in fixed positions adjacent an upper portion of a cover enclosure of the indoor skiing facilities, and being independently supplied with compressed air and water by said compressed air means and water supply means and independently exhausted of excess water by said water exhaust means.

2. The method of claim 1, wherein said inside temperature is from −6° C. to less than −4° C.

3. The method of claim 2, wherein said particle size of the waterdrops is from 60 to 200 μm.

4. The method of claim 1, wherein said temperature is from −6° C. to less than −4° C. and said particle size of the waterdrops is from 40 μm to less than 60.

5. The method of claim 1, wherein said temperature is from −6° C. to less than −4° C. and said particle size of the waterdrops is from 5 μm to less than 60.

6. The method of claim 1, wherein said temperature is from −4° C. to −2° C.

7. The method of claim 6, wherein said particle size of the waterdrops is from 5 to 40 μm.

8. The method of claim 1, wherein said temperature is from −4° C. to −2° C. and said particle size of the waterdrops is from 20 μm to less than 40.

9. The method of claim 1, wherein said temperature is from −4° C. to −2° C. and said particle size of the waterdrops is from 5 μm to less than 20.

10. The method of claim 1, wherein said upper portion of said cover enclosure comprises a portion of a ceiling of said indoor skiing facilities.

11. The method of claim 1, wherein said upper portion of said cover enclosure is a comparatively upper portion of the side walls of said indoor skiing facility.

12. The method of claim 1, wherein the artificially produced snow is transformed into snow-like ice in the state of sherbet, compact snow or powdery snow by controlling said particle size of the waterdrops from said two-fluid spray nozzles, the temperature of the air supplied to the nozzles, said air-water ratio and said inside temperature of said facility.

13. The method of claim 1, wherein said plurality of two-fluid spray nozzles are arranged at equal intervals onto said upper portion of said cover enclosure.

14. A method for artificially producing snow for an indoor facility comprising:

providing holes for blowing cold air into the indoor skiing facility;

providing holes for exhausting air from the skiing facility;

maintaining an inside temperature of the indoor skiing facility at 0° C. or less by means of said holes for blowing cold air and for exhausting air;

providing compressed air supply means, water supply means and water exhaust means; and blowing compressed air and water with an air-water ratio of 300 to 3000 Nm$^3$/m$^3$ in volume through a plurality of grouped two-fluid spray nozzles to generate and spread waterdrops of a particle size of 5 to 200 μm into the indoor skiing facility, said grouped two-fluid spray nozzles being independently supplied with compressed air and water by said compressed air means and water supply means and independently exhausted of excess water by said water exhaust means.

15. An apparatus for artificially producing snow comprising:

an indoor skiing facility having a floor and a cover enclosure comprising a ceiling and side walls, said cover enclosure and said floor being made from an insulating material;

holes for blowing cold air into the indoor facility to maintain an inside temperature, said holes for blowing air being disposed adjacent an upper portion of the cover enclosure;

holes for exhausting air from the indoor facility to facilitate maintenance of said inside temperature, said holes for exhausting air being disposed adjacent a comparatively lower portion of said side walls of the cover enclosure; and a plurality of snow making means disposed at fixed positions within the indoor facility for independently making snow at said fixed positions, each of said snow making means comprising:

a plurality of two-fluid spray nozzles for blowing compressed air and water into the indoor facility, said spray nozzles being spaced apart in fixed positions adjacent said upper portion of said cover enclosure;

compressed air supply means for supplying compressed air to each of said plurality of two-fluid spray nozzles;

water supply means for supplying water to each of said plurality of two-fluid spray nozzles; and water exhaust means for removing excess water unused by said plurality of two-fluid spray nozzles.

16. The apparatus of claim 15, wherein said upper portion of the cover enclosure comprises a portion of said ceiling of said cover enclosure.

17. The apparatus claim 15, wherein said upper portion of said cover enclosure comprises a portion of said side walls.

18. The apparatus of claim 15, wherein said plurality of two-fluid spraying nozzles are disposed at equal intervals apart from each other.

19. The apparatus of claim 15, wherein said upper portion of said cover enclosure is a comparatively upper portion of said said walls.

* * * * *

UNITED STATES PATENT AND TRADEMARK OFFICE

CERTIFICATE OF CORRECTION

PATENT NO. : 5,102,044

DATED : April 7, 1992

INVENTOR(S) : INOUE et al

It is certified that error appears in the above-identified patent and that said Letters Patent is hereby corrected as shown below:

IN THE DRAWINGS:

Replace Fig.2 (sheet 2 of 2) with the one attached hereto.

Column 1, line 45, replace "had" with --has--.

Column 5, claim 1 (lines 8-9), delete "providing holes for exhausting air from the indoor skiing facility;"

Signed and Sealed this

Fourteenth Day of December, 1993

*Attest:*

Bruce Lehman

BRUCE LEHMAN

*Attesting Officer*

*Commissioner of Patents and Trademarks*